US010617927B2

(12) United States Patent
Osorio et al.

(10) Patent No.: US 10,617,927 B2
(45) Date of Patent: Apr. 14, 2020

(54) EXERCISE ASSEMBLY

(71) Applicants: John Osorio, Alpine, CA (US); Libia Marquez, Alpine, CA (US)

(72) Inventors: John Osorio, Alpine, CA (US); Libia Marquez, Alpine, CA (US)

( * ) Notice: Subject to any disclaimer, the term of this patent is extended or adjusted under 35 U.S.C. 154(b) by 84 days.

(21) Appl. No.: 15/983,509

(22) Filed: May 18, 2018

(65) Prior Publication Data

US 2019/0351299 A1 Nov. 21, 2019

(51) Int. Cl.
*A63B 69/00* (2006.01)
*A63B 22/20* (2006.01)

(52) U.S. Cl.
CPC ..... *A63B 69/0022* (2013.01); *A63B 22/203* (2013.01); *A63B 2208/0204* (2013.01)

(58) Field of Classification Search
CPC .. A63B 1/00; A63B 1/005; A63B 3/00; A63B 9/00; A63B 2009/006; A63B 17/00; A63B 17/02; A63B 17/04; A63B 21/00047; A63B 21/0005; A63B 21/00054; A63B 21/00069; A63B 21/00072; A63B 21/00076; A63B 21/00185; A63B 21/012; A63B 21/0125; A63B 21/065; A63B 21/068; A63B 21/15; A63B 21/159; A63B 21/4023; A63B 21/4027; A63B 21/4029; A63B 21/4033; A63B 21/4034; A63B 21/4035; A63B 21/4037; A63B 21/4039; A63B 21/4041; A63B 21/4045; A63B 22/025; A63B 22/0046; A63B 22/0292; A63B 22/20; A63B 22/201; A63B 22/203; A63B 22/208; A63B 2022/0038; A63B 2022/206; A63B 23/035; A63B 23/03533; A63B 23/03541; A63B 23/03575; A63B 23/04; A63B 23/0405; A63B 23/0417; A63B 23/047; A63B 23/0482; A63B 23/0488; A63B 23/0494; A63B 23/12; A63B 23/1209; A63B 23/1227; A63B 23/1236; A63B 23/1245; A63B 23/1263; A63B 23/1281; A63B 69/0022;

(Continued)

(56) References Cited

U.S. PATENT DOCUMENTS 291,821 A 1/1884 Walsh
2,646,282 A * 7/1953 Ringman ..... A63B 21/0004 482/51

(Continued)

FOREIGN PATENT DOCUMENTS

DE 2730892 A1 * 1/1979 ..... A63B 22/203

*Primary Examiner* — Gary D Urbiel Goldner

(57) ABSTRACT

An exercise assembly for practicing in-line skating includes a base that has an upper surface with a smooth texture to provide minimal friction to sliding. Each of a pair of front tubes and each of a pair of rear tubes extends perpendicularly from a respective opposing side of the base. A crossbar extends between the pair of front tubes distal from the base. Each front tube comprises a plurality of nested sections. Each rear tube comprises a plurality of nested segments. The front tubes and the rear tubes are selectively extensible from the base. Each of a pair of side bars extends between a respective front tube and an associated rear tube. The side bars and the crossbar are selectively positionable relative to the base and are configured to be grasped in hands of a user to support the user exercising on the base.

13 Claims, 6 Drawing Sheets

(58) Field of Classification Search
CPC ..... A63B 69/0028; A63B 69/0035; A63B 69/0064; A63B 69/18; A63B 69/182; A63B 71/0009; A63B 71/0036; A63B 71/0054; A63B 2071/0018; A63B 2208/0204; A63B 2208/0295; A63B 2210/00; A63B 2210/50; A63B 2210/58; A63B 2225/09; A63B 2225/093; A63B 2225/10; A63B 2244/18; A63B 2244/186; A63B 2244/19
See application file for complete search history.

(56) References Cited

U.S. PATENT DOCUMENTS 3,130,968 A * 4/1964 De Feen ..... A63B 23/00 482/132
3,405,954 A * 10/1968 Wolfe ..... A61G 5/14 280/304.1
3,589,720 A * 6/1971 Agamian ..... A63B 21/012 482/114
3,598,405 A * 8/1971 Burns ..... A63B 23/0211 482/145
3,709,488 A * 1/1973 Garner ..... A63B 23/00 482/145
4,126,307 A * 11/1978 Stevenson ..... A63B 1/00 248/363
4,314,576 A * 2/1982 McGee ..... A61F 5/0104 135/67
4,334,676 A * 6/1982 Schonenberger ..... A63B 22/02 482/54
4,434,981 A 3/1984 Norton
4,529,194 A 7/1985 Haaheim
4,625,962 A * 12/1986 Street ..... A63B 21/015 482/116
4,666,154 A * 5/1987 Lipscomb ..... A63B 21/00047 482/142
4,804,178 A * 2/1989 Friedebach ..... A63B 22/0012 482/114
4,951,942 A * 8/1990 Walden ..... A63B 21/04 482/130
4,979,731 A * 12/1990 Hermelin ..... A63B 22/001 482/51
5,108,093 A * 4/1992 Watterson ..... A63B 22/0012 482/112
5,226,439 A * 7/1993 O'Keeffe ..... A47C 7/62 135/66
5,328,427 A * 7/1994 Sleamaker ..... A63B 21/154 482/110
5,347,666 A * 9/1994 Kippes ..... A61G 7/10 135/67
5,385,520 A 1/1995 Lepine
5,451,194 A 9/1995 Harrigan
5,518,476 A * 5/1996 McLeon ..... A63B 23/08 482/131
5,538,489 A * 7/1996 Magid ..... A47D 13/04 482/54
5,643,162 A * 7/1997 Landers ..... A63B 21/154 482/131
5,830,114 A * 11/1998 Halfen ..... A63B 22/0012 482/70
5,971,891 A 10/1999 Humphrey
6,168,548 B1 * 1/2001 Fleming ..... A63B 3/00 482/23
6,368,253 B1 4/2002 Harrigan
7,510,511 B2 * 3/2009 von Detten ..... A63B 22/02 482/54
7,942,835 B2 * 5/2011 Talish ..... A61H 1/005 601/2
7,992,881 B2 * 8/2011 Edelblut ..... A47B 83/001 280/206
8,137,250 B1 * 3/2012 Caban ..... A63B 21/018 482/131
8,500,611 B2 * 8/2013 Hoffman ..... A63B 21/055 482/123
9,737,748 B1 * 8/2017 Chapman ..... A63B 21/0442
9,821,184 B1 * 11/2017 Chapman ..... A63B 21/1681
10,166,165 B1 * 1/2019 McGuire ..... A61H 3/04
10,252,095 B1 * 4/2019 Carnahan ..... A63B 3/00
2005/0079956 A1 * 4/2005 Bruno ..... A63B 22/203 482/51
2005/0187086 A1 * 8/2005 Bull ..... A63B 23/03541 482/142
2007/0117687 A1 * 5/2007 Larson ..... A63B 22/203 482/70
2010/0240498 A1 * 9/2010 Robinson ..... A63B 22/02 482/54
2013/0005541 A1 * 1/2013 Robinson ..... A63B 22/02 482/54
2014/0141948 A1 * 5/2014 Aronson ..... A63B 21/023 482/128
2016/0038782 A1 * 2/2016 Broffman ..... A63B 69/06 482/72
2016/0317863 A1 * 11/2016 Goldberg ..... A63B 21/0087
2017/0326407 A1 * 11/2017 Johnson ..... A63B 21/4045
2017/0333744 A1 * 11/2017 Chapman ..... A61H 1/024
2017/0368400 A1 * 12/2017 Chapman ..... A63B 21/0555

* cited by examiner

EXERCISE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art including Information Disclosed under 37 CFR 1.97 and 1.98

The disclosure and prior art relates to exercise assemblies and more particularly pertains to a new exercise assembly for practicing in-line skating.

BRIEF SUMMARY OF THE INVENTION

An embodiment of the disclosure meets the needs presented above by generally comprising a base that has an upper surface with a smooth texture to provide minimal friction to sliding. Each of a pair of front tubes and each of a pair of rear tubes extends perpendicularly from a respective opposing side of the base. A crossbar extends between the pair of front tubes distal from the base. Each front tube comprises a plurality of nested sections. Each rear tube comprises a plurality of nested segments. The front tubes and the rear tubes are selectively extensible from the base. Each of a pair of side bars extends between a respective front tube and an associated rear tube. The side bar and the crossbar are selectively positionable relative to the base and are configured to be grasped in hands of a user to support the user exercising on the base.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
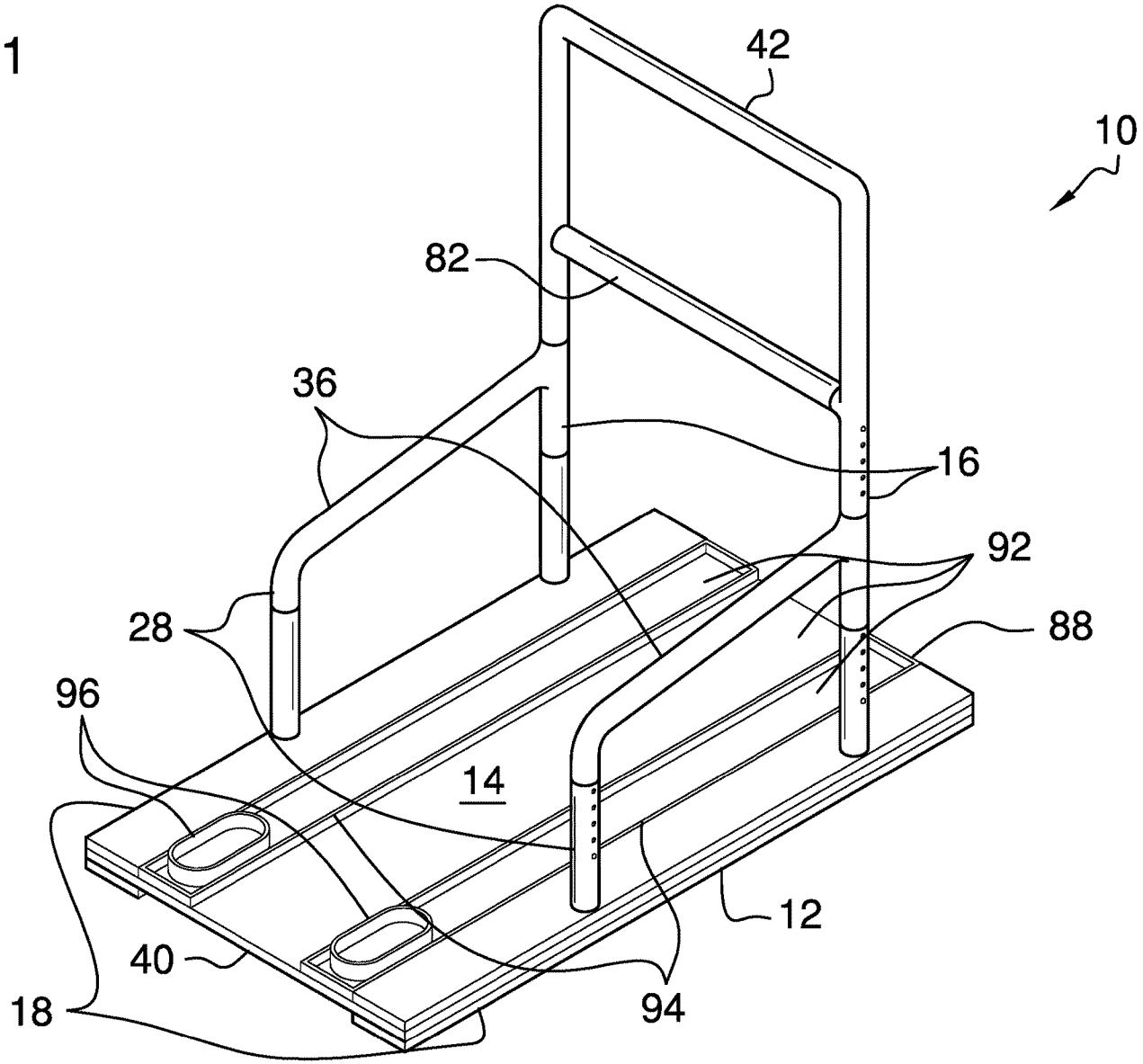
FIG. 1 is an isometric perspective view of an exercise assembly according to an embodiment of the disclosure.

With reference now to the drawings, and in particular to FIGS. 1 through 6 thereof, a new exercise assembly embodying the principles and concepts of an embodiment of the disclosure and generally designated by the reference numeral 10 will be described.

As best illustrated in FIGS. 1 through 6, the exercise assembly 10 generally comprises a base 12 that has an upper surface 14. The upper surface 14 has a smooth texture so that the upper surface 14 provides minimal friction to sliding.

Figure 4:
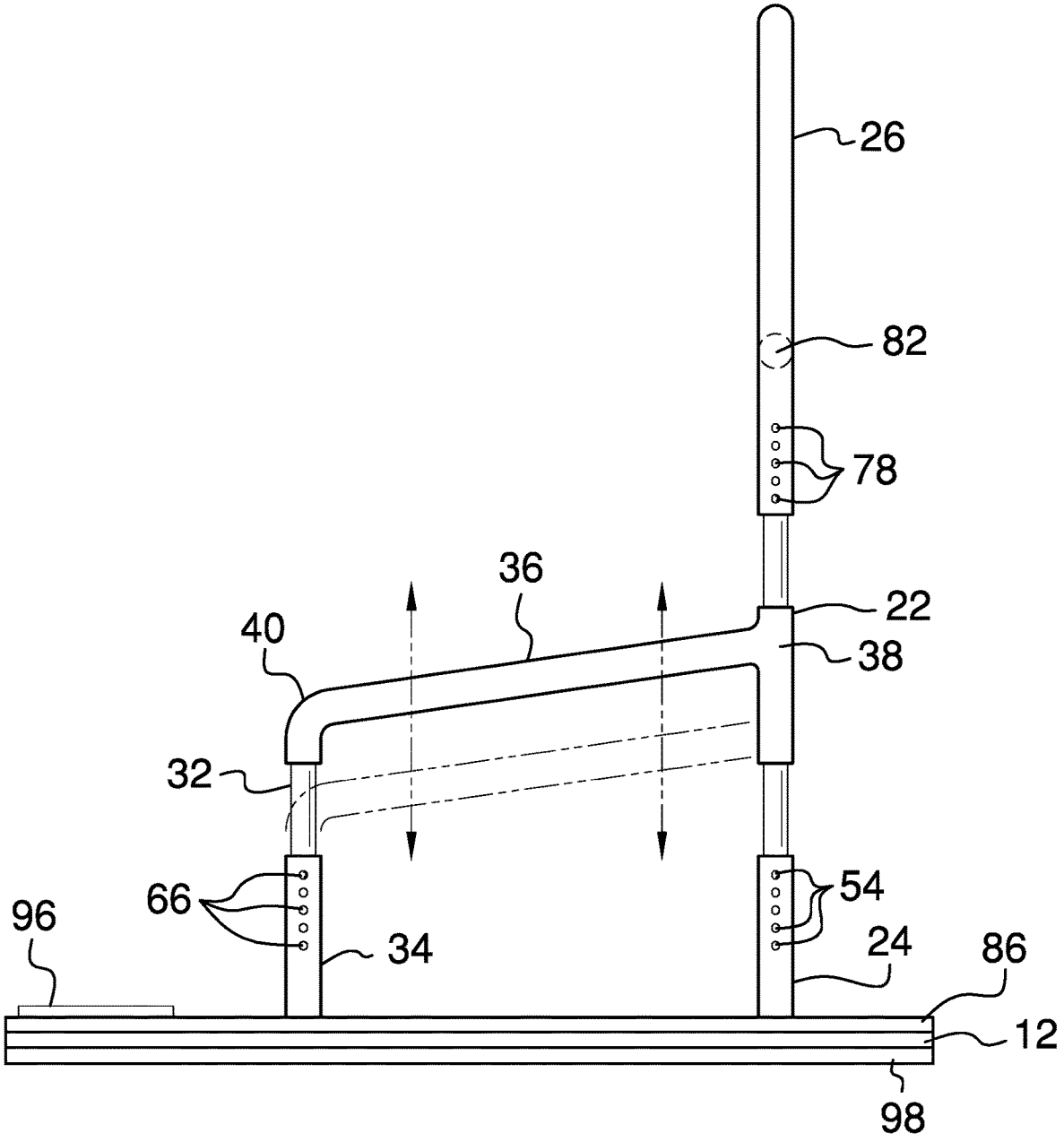
FIG. 4 is a side view of an embodiment of the disclosure.

Each of a pair of front tubes 16 is coupled to and extends perpendicularly from a respective opposing side 18 of the base 12. The front tubes 16 are circularly shaped when viewed longitudinally. Each front tube 16 comprises a plurality of nested sections 20, as shown in FIG. 4, so that the front tube 16 is selectively extensible from the base 12. The plurality of nested sections 20 comprises a medial section 22 that is selectively extensible from a lower section 24. The plurality of nested sections 20 also comprises an upper section 26 that is selectively extensible from the medial section 22.

Each of a pair of rear tubes 28 is coupled to and extends perpendicularly from the respective opposing side 18 of the base 12. The rear tubes 28 are circularly shaped when viewed longitudinally. Each rear tube 28 comprises a plurality of nested segments 30, as shown in FIG. 4, so that the rear tube 28 is selectively extensible from the base 12. The plurality of nested segments 30 comprises an upper segment 32 that selectively extensible from a lower segment 34.

Figure 5:
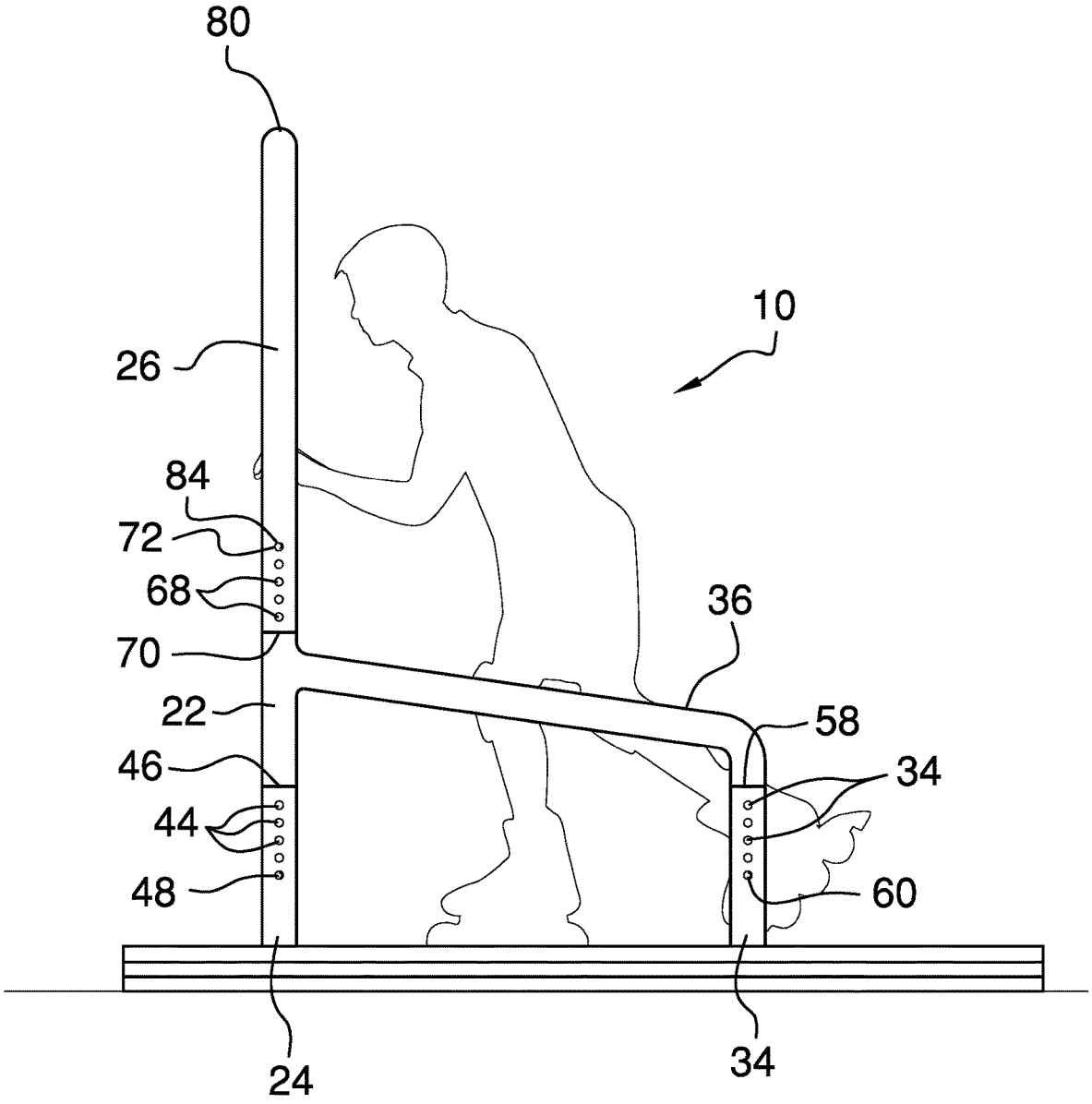
FIG. 5 is an in-use view of an embodiment of the disclosure.

Each of a pair of side bars 36 is coupled to and extends between a respective front tube 16 and an associated rear tube 28, as shown in FIG. 5. The side bar 36 is selectively positionable relative to the base 12. The side bar 36 extends between proximate to a midpoint 38 of the medial section 22 and a top terminus 40 of the upper segment 32. The medial section 22 is dimensionally longer than the upper segment 32 so that the side bar 36 extends downwardly between the medial section 22 and the upper segment 32. The side bars 36 are circularly shaped when viewed longitudinally.

Figure 6:
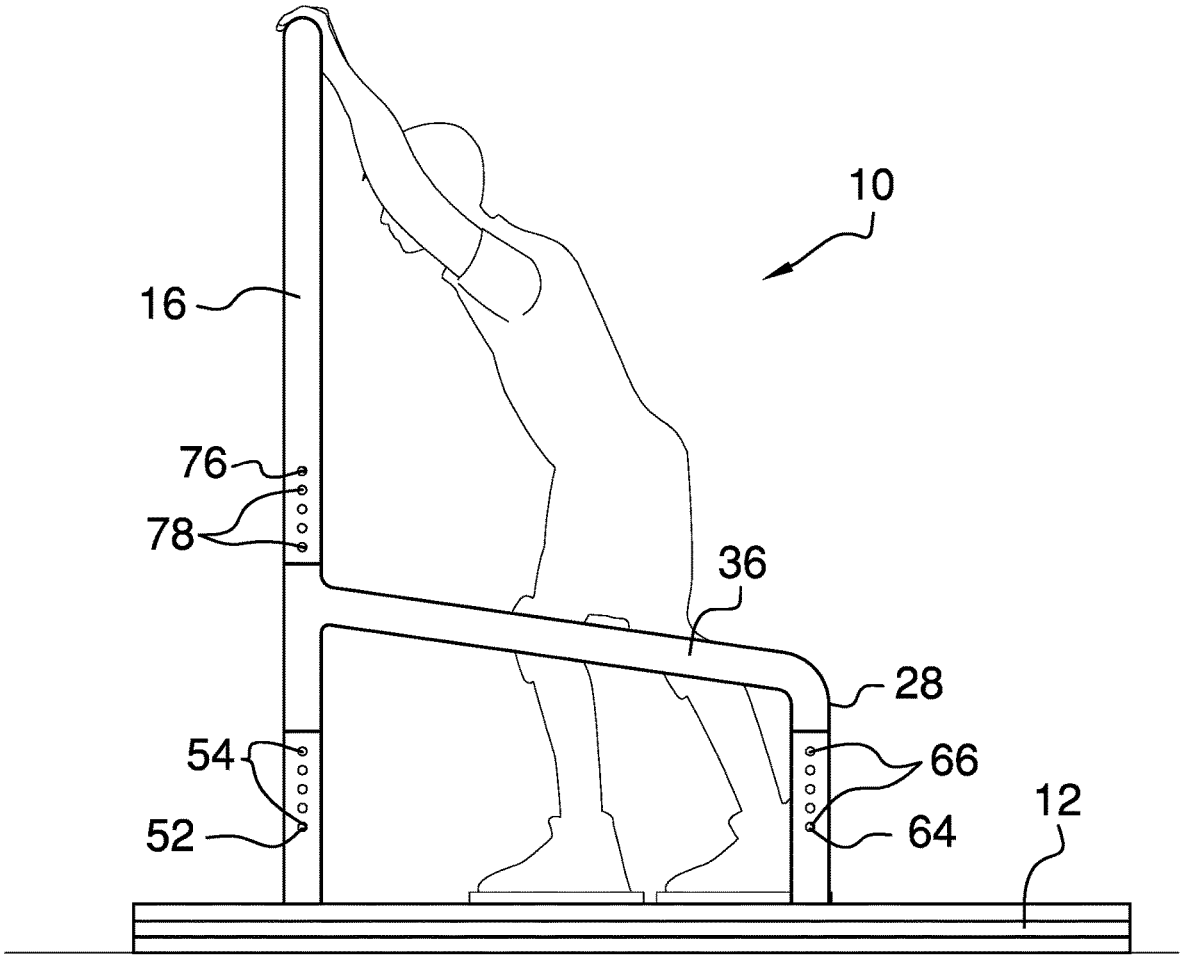
FIG. 6 is an in-use view of an embodiment of the disclosure.

A crossbar 42 is coupled to and extends between the pair of front tubes 16 distal from the base 12. The crossbar 42 is circularly shaped when viewed longitudinally. The crossbar 42 is selectively positionable relative to the base 12. The crossbar 42 and the side bars 36 are configured to be selectively grasped in hands of a user to support the user who is exercising on the base 12, such as the user who practicing in-line skating as shown in FIG. 6.

Each of a pair of first couplers 44 is coupled to a respective lower section 24 proximate to an upper endpoint 46 of the respective lower section 24. Each of a pair of second couplers 48 is coupled to a respective medial section 22 proximate to a bottom endpoint 50 of the respective medial section 22. The second couplers 48 are complementary to the first couplers 44. Each second coupler 48 is positioned to selectively couple to an associated first coupler 44 to couple the respective medial section 22 to the respective lower section 24.

Figure 2:
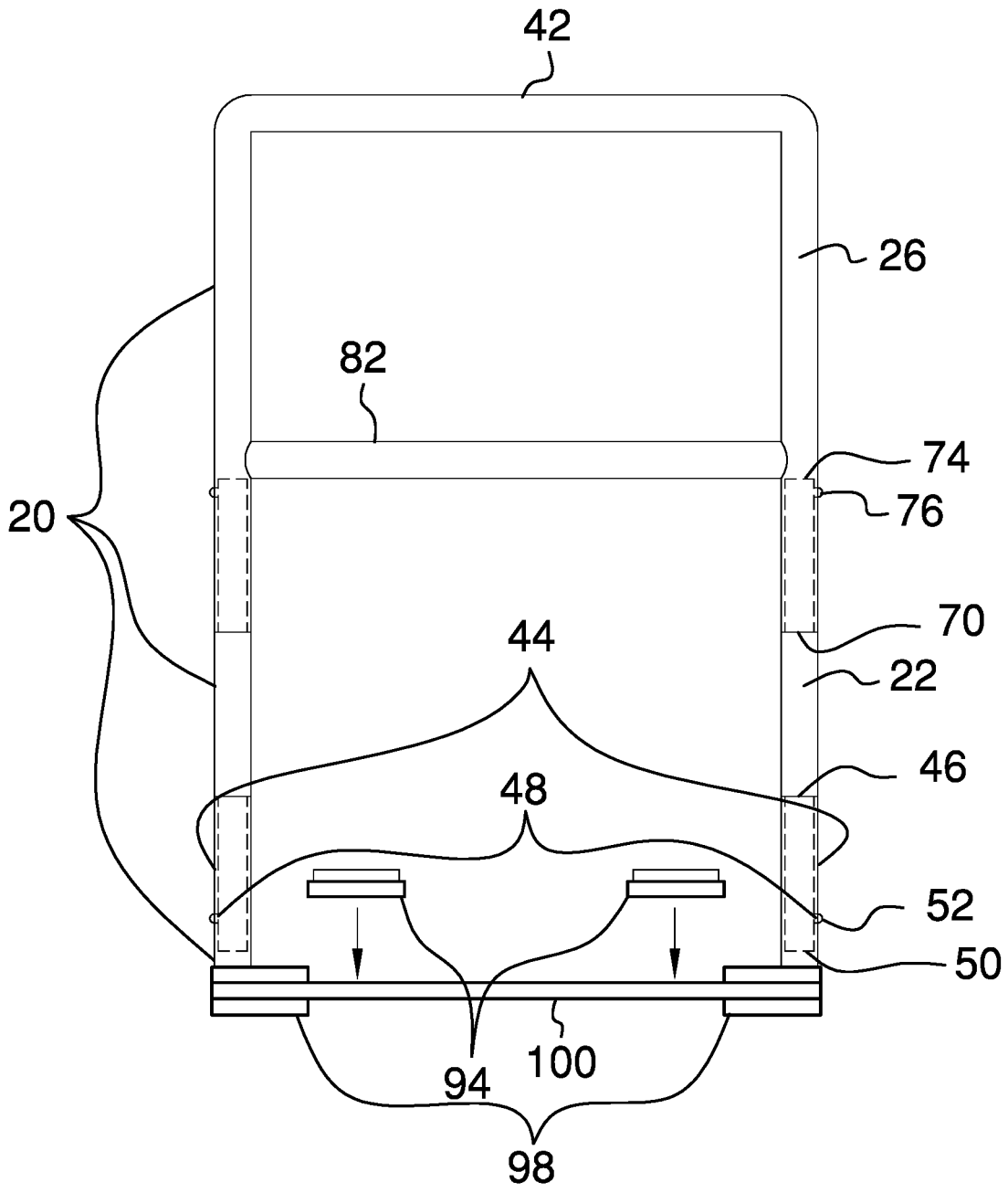
FIG. 2 is a front view of an embodiment of the disclosure.

Each second coupler 48 comprises a front pin 52, as shown in FIG. 2. The front pin 52 is spring-loaded. Each first coupler 44 comprises a plurality of front holes 54 that extends from proximate to the upper endpoint 46 of the respective lower section 24 toward the base 12. The front pin 52 is positioned to be depressed to slide the respective medial section 22 relative to the respective lower section 24. The front pin 52 is positioned to insert into a respective front hole 54 to fixedly position the respective medial section 22 relative to the respective lower section 24. The plurality of front holes 54 comprises five front holes 54.

Each of a pair of first connectors 56 is coupled to a respective lower segment 34 proximate to an upper terminus 58 of the respective lower segment 34. Each of a pair of second connectors 60 is coupled to a respective upper segment 32 proximate to a bottom terminus 62 of the respective upper segment 32. The second connectors 60 are complementary to the first connectors 56. Each second connector 60 is positioned to selectively couple to an associated first connector 56 to couple the respective upper segment 32 to the respective lower segment 34.

Figure 3:
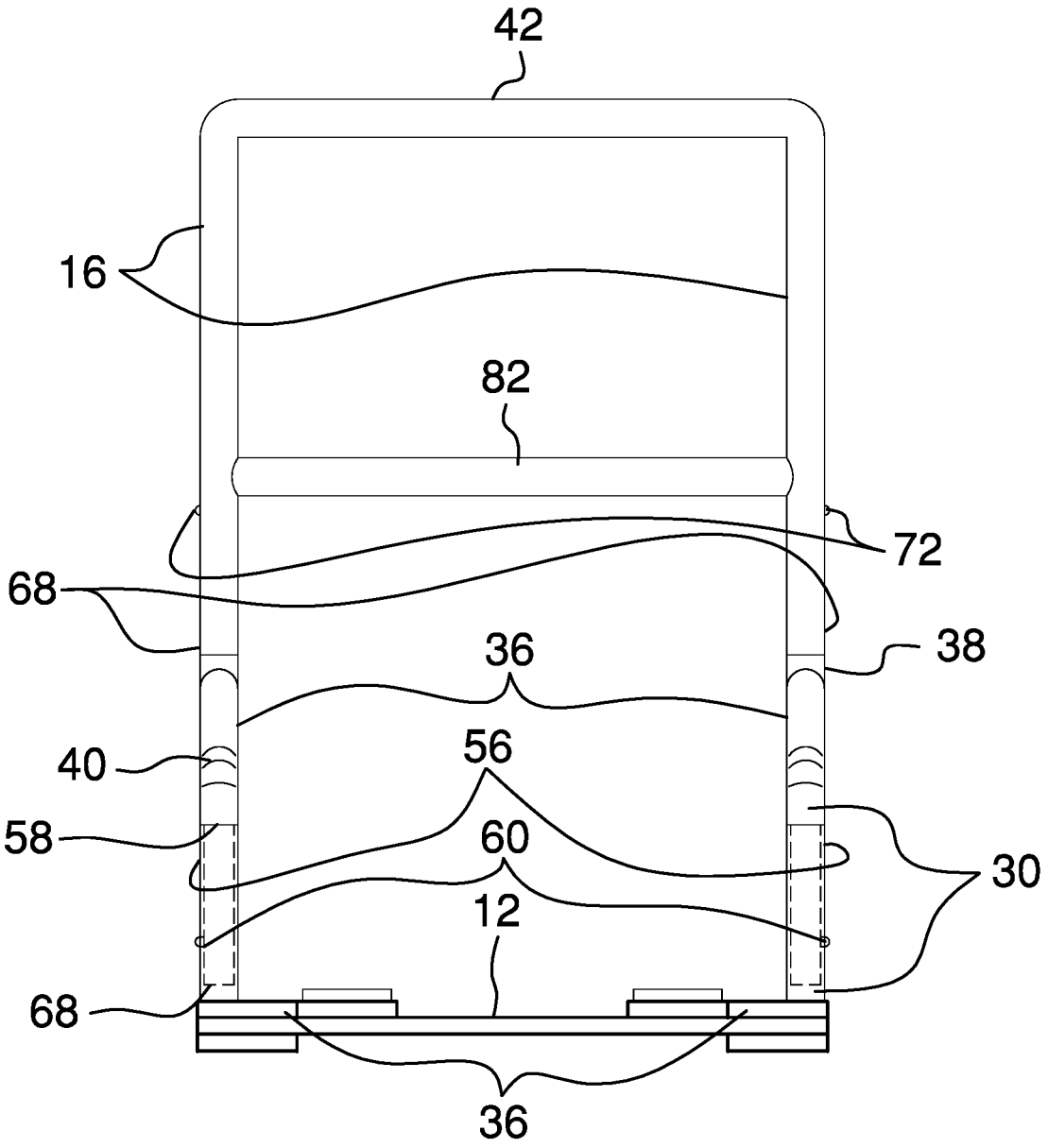
FIG. 3 is a back view of an embodiment of the disclosure.

Each second connector 60 comprises a back pin 64, as shown in FIG. 3. The back pin 64 is spring-loaded. Each first connector 56 comprises a plurality of back holes 66 that extends from proximate to the upper terminus 58 of the respective lower segment 34 toward the base 12. The back pin 64 is positioned to be depressed to slide the respective upper segment 32 relative to the respective lower segment 34. The back pin 64 is positioned to insert into a respective back hole 66 to fixedly position the respective upper segment 32 relative to the respective lower segment 34. The plurality of back holes 66 comprises five back holes 66.

Each of a pair of first fasteners 68 is coupled to a respective upper section 26 proximate to a lower end 70 of the respective upper section 26. Each of a pair of second fasteners 72 is coupled to a respective medial section 22 proximate to a top end 74 of the respective medial section 22. The second fasteners 72 are complementary to the first fasteners 68. Each second fastener 72 is positioned to selectively couple to an associated first fastener 68 to couple the respective medial section 22 to the respective upper section 26.

Each second fastener 72 comprises a top pin 76, as shown in FIG. 2. The top pin 76 is spring-loaded. Each first fastener 68 comprises a plurality of orifices 78 that extends from proximate to the lower end 70 toward an upper end 80 of the respective upper section 26. The top pin 76 is positioned to be depressed to slide the respective upper section 26 relative to the respective medial section 22. The top pin 76 is positioned to insert into a respective orifice 78 to fixedly position the respective upper section 26 relative to the respective medial section 22. The plurality of orifices 78 comprises five orifices 78.

A crossbeam 82 is coupled to and extends between the upper sections 26. The crossbeam 82 is circularly shaped when viewed longitudinally. The crossbeam 82 is positioned proximate to an upper limit 84 of each plurality of orifices 78. The crossbeam 82 is configured to be grasped in the hands of the user to support the user who is exercising on the base 12.

Each of a pair of top plates 86 is coupled to the upper surface 14 of the base 12 and extends along a respective opposing side 18 of the base 12 from a front edge 88 to a back edge 90 of the base 12, as shown in FIG. 4. The top plates 86 define a slide area 92 on the upper surface 14, as shown in FIG. 1.

Each of a pair of frames 94 is selectively couplable to the upper surface 14 of the base 12 so that the frame 94 is positioned adjacent to a respective top plate 86, as shown in FIG. 2. The frame 94 extends from the front edge 88 to the back edge 90 of the base 12.

Each of a pair of rings 96 is slidably positioned in a respective frame, as shown in FIG. 1. The rings 96 are ovally shaped such that each ring 96 is configured to insert a respective shoed foot of the user. The user is positioned to slide the user's feet along the upper surface 14, as shown in FIG. 6.

Each of a pair of bottom plates 98 is coupled to a lower surface 100 of the base 12 and extends along a respective opposing side 18 of the base 12 from the front edge 88 to the back edge 90 of the base 12, as shown in FIG. 4.

In use, the front pins 52 and the back pins 64 are depressed to position the pair of side bars 36 to support the user. The top pin 76 is depressed to position the crossbar 42 and the crossbeam 82 to support the user. The user may elect to grasp the side bars 36, the crossbar 42, or the crossbeam 82, depending on the type of exercise. The slide area 92 provides minimal friction when practicing in-line skating on the base 12 or when sliding the feet that are positioned in the rings 96 within the frames 94.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An exercise assembly comprising:

a base, said base having an upper surface, said upper surface having a smooth texture such that said upper surface provides minimal friction to sliding;

a pair of front tubes, each said front tube being coupled to and extending perpendicularly from a respective opposing side of said base, each said front tube comprising a plurality of nested sections such that said front tube is selectively extensible from said base;

a pair of rear tubes, each said rear tube being coupled to and extending perpendicularly from said respective said opposing side of said base, each said rear tube comprising a plurality of nested segments such that said rear tube is selectively extensible from said base;

a pair of side bars, each said side bar being coupled to and extending between a respective said front tube and an associated said rear tube such that said side bar is selectively positionable relative to said base;

a crossbar coupled to and extending between said pair of front tubes distal from said base such that said crossbar is selectively positionable relative to said base wherein said crossbar and said side bars are configured for being selectively grasped in hands of a user for supporting the user exercising on said base;

a pair of top plates, each said top plate being coupled to said upper surface of said base and extending along said respective said opposing side of said base from a front edge to a back edge of said base wherein said top plates define a slide area on said upper surface;

a pair of frames, each said frame being selectively coupleable to said upper surface of said base such that said frame is positioned adjacent to a respective said top plate, said frame extending from said front edge to said back edge of said base; and a pair of rings, said rings being ovally shaped such that each said ring is configured for inserting a respective shoed foot of the user, each said ring being slidably positioned in a respective said frame configured for positioning the user for sliding the user's feet along said upper surface.

2. The exercise assembly of claim 1, further including a pair of bottom plates, each said bottom plate being coupled to a lower surface of said base and extending along said respective said opposing side of said base from said front edge to said back edge of said base.

3. The exercise assembly of claim 1, further comprising:

said plurality of nested sections comprising a medial section selectively extensible from a lower section, said plurality of nested sections comprising an upper section selectively extensible from said medial section, said front tubes being circularly shaped when viewed longitudinally;

said plurality of nested segments comprising an upper segment selectively extensible from a lower segment, said rear tubes being circularly shaped when viewed longitudinally;

said side bar extending between proximate to a midpoint of said medial section and a top terminus of said upper segment, said medial section being dimensionally longer than said upper segment such that said side bar extends downwardly between said medial section and said upper segment, said side bars being circularly shaped when viewed longitudinally;

said crossbar being circularly shaped when viewed longitudinally;

a pair of first couplers, each said first coupler being coupled to a respective said lower section proximate to an upper endpoint of said respective said lower section;

a pair of second couplers, each said second coupler being coupled to a respective said medial section proximate to a bottom endpoint of said respective said medial section, said second couplers being complementary to said first couplers wherein each said second coupler is positioned for selectively coupling to an associated said first coupler for coupling said respective said medial section to said respective said lower section, each said second coupler comprising a front pin, said front pin being spring-loaded, each said first coupler comprising a plurality of front holes extending from proximate to said upper endpoint of said respective said lower section toward said base wherein said front pin is positioned for depressing for sliding said respective said medial section relative to said respective said lower section positioning said front pin for inserting into a respective said front hole for fixedly positioning said respective said medial section relative to said respective said lower section, said plurality of front holes comprising five said front holes;

a pair of first connectors, each said first connector being coupled to a respective said lower segment proximate to an upper terminus of said respective said lower segment;

a pair of second connectors, each said second connector being coupled to a respective said upper segment proximate to a bottom terminus of said respective said upper segment, said second connectors being complementary to said first connectors wherein each said second connector is positioned for selectively coupling to an associated said first connector for coupling said respective said upper segment to said respective said lower segment, each said second connector comprising a back pin, said back pin being spring-loaded, each said first connector comprising a plurality of back holes extending from proximate to said upper terminus of said respective said lower segment toward said base wherein said back pin is positioned for depressing for sliding said respective said upper segment relative to said respective said lower segment positioning said back pin for inserting into a respective said back hole for fixedly positioning said respective said upper segment relative to said respective said lower segment, said plurality of back holes comprising five said back holes;

a pair of first fasteners, each said first fastener being coupled to a respective said upper section proximate to a lower end of said respective said upper section;

a pair of second fasteners, each said second fastener being coupled to a respective said medial section proximate to a top end of said respective said medial section, said second fasteners being complementary to said first fasteners wherein each said second fastener is positioned for selectively coupling to an associated said first fastener for coupling said respective said medial section to said respective said upper section, each said second fastener comprising a top pin, said top pin being spring-loaded, each said first fastener comprising a plurality of orifices extending from proximate to said lower end of said respective said upper section toward an upper end of said respective said upper section wherein said top pin is positioned for depressing for sliding said respective said upper section relative to said respective said medial section positioning said top pin for inserting into a respective said orifice for fixedly positioning said respective said upper section relative to said respective said medial section, said plurality of orifices comprising five said orifices;

a crossbeam coupled to and extending between said upper sections, said crossbeam being positioned proximate to an upper limit of each said plurality of orifices wherein said crossbeam is configured for grasping in the hands of the user for supporting the user exercising on said base, said crossbeam being circularly shaped when viewed longitudinally; and a pair of bottom plates, each said bottom plate being coupled to a lower surface of said base and extending along said respective said opposing side of said base from said front edge to said back edge of said base.

4. An exercise assembly comprising:

a base, said base having an upper surface, said upper surface having a smooth texture such that said upper surface provides minimal friction to sliding;

a pair of front tubes, each said front tube being coupled to and extending perpendicularly from a respective opposing side of said base, each said front tube comprising a plurality of nested sections such that said front tube is selectively extensible from said base;

a pair of rear tubes, each said rear tube being coupled to and extending perpendicularly from said respective said opposing side of said base, each said rear tube comprising a plurality of nested segments such that said rear tube is selectively extensible from said base;

a pair of side bars, each said side bar being coupled to and extending between a respective said front tube and an associated said rear tube such that said side bar is selectively positionable relative to said base;

a crossbar coupled to and extending between said pair of front tubes distal from said base such that said crossbar is selectively positionable relative to said base wherein said crossbar and said side bars are configured for being selectively grasped in hands of a user for supporting the user exercising on said base;

said plurality of nested sections comprising a medial section selectively extensible from a lower section;

said plurality of nested segments comprising an upper segment selectively extensible from a lower segment; and said side bar extending between proximate to a midpoint of said medial section and a top terminus of said upper segment, said medial section being dimensionally longer than said upper segment such that said side bar extends downwardly between said medial section and said upper segment.

5. The exercise assembly of claim 4, further comprising:

a pair of first couplers, each said first coupler being coupled to a respective said lower section proximate to an upper endpoint of said respective said lower section;

a pair of second couplers, each said second coupler being coupled to a respective said medial section proximate to a bottom endpoint of said respective said medial section, said second couplers being complementary to said first couplers wherein each said second coupler is positioned for selectively coupling to an associated said first coupler for coupling said respective said medial section to said respective said lower section;

a pair of first connectors, each said first connector being coupled to a respective said lower segment proximate to an upper terminus of said respective said lower segment; and a pair of second connectors, each said second connector being coupled to a respective said upper segment proximate to a bottom terminus of said respective said upper segment, said second connectors being complementary to said first connectors wherein each said second connector is positioned for selectively coupling to an associated said first connector for coupling said respective said upper segment to said respective said lower segment.

6. The exercise assembly of claim 5, further comprising:

each said second coupler comprising a front pin, said front pin being spring-loaded, each said first coupler comprising a plurality of front holes extending from proximate to said upper endpoint of said respective said lower section toward said base wherein said front pin is positioned for depressing for sliding said respective said medial section relative to said respective said lower section positioning said front pin for inserting into a respective said front hole for fixedly positioning said respective said medial section relative to said respective said lower section; and each said second connector comprising a back pin, said back pin being spring-loaded, each said first connector comprising a plurality of back holes extending from proximate to said upper terminus of said respective said lower segment toward said base wherein said back pin is positioned for depressing for sliding said respective said upper segment relative to said respective said lower segment positioning said back pin for inserting into a respective said back hole for fixedly positioning said respective said upper segment relative to said respective said lower segment.

7. The exercise assembly of claim 6, further comprising:

said plurality of front holes comprising five said front holes; and said plurality of back holes comprising five said back holes.

8. The exercise assembly of claim 5, further comprising:

said plurality of nested sections comprising an upper section selectively extensible from said medial section;

a pair of first fasteners, each said first fastener being coupled to a respective said upper section proximate to a lower end of said respective said upper section; and a pair of second fasteners, each said second fastener being coupled to a respective said medial section proximate to a top end of said respective said medial section, said second fasteners being complementary to said first fasteners wherein each said second fastener is positioned for selectively coupling to an associated said first fastener for coupling said respective said medial section to said respective said upper section.

9. The exercise assembly of claim 8, further including each said second fastener comprising a top pin, said top pin being spring-loaded, each said first fastener comprising a plurality of orifices extending from proximate to said lower end of said respective said upper section toward an upper end of said respective said upper section wherein said top pin is positioned for depressing for sliding said respective said upper section relative to said respective said medial section positioning said top pin for inserting into a respective said orifice for fixedly positioning said respective said upper section relative to said respective said medial section.

10. The exercise assembly of claim 9, further including said plurality of orifices comprising five said orifices.

11. The exercise assembly of claim 9, further including a crossbeam coupled to and extending between said upper sections, said crossbeam being positioned proximate to an upper limit of each said plurality of orifices wherein said crossbeam is configured for grasping in the hands of the user for supporting the user exercising on said base.

12. The exercise assembly of claim 11, further including said crossbeam being circularly shaped when viewed longitudinally.

13. An exercise assembly comprising:

a base, said base having an upper surface, said upper surface having a smooth texture such that said upper surface provides minimal friction to sliding;

a pair of front tubes, each said front tube being coupled to and extending perpendicularly from a respective opposing side of said base, each said front tube comprising a plurality of nested sections such that said front tube is selectively extensible from said base;

a pair of rear tubes, each said rear tube being coupled to and extending perpendicularly from said respective said opposing side of said base, each said rear tube comprising a plurality of nested segments such that said rear tube is selectively extensible from said base;

a pair of side bars, each said side bar being coupled to and extending between a respective said front tube and an associated said rear tube such that said side bar is selectively positionable relative to said base;

a crossbar coupled to and extending between said pair of front tubes distal from said base such that said crossbar is selectively positionable relative to said base wherein said crossbar and said side bars are configured for being selectively grasped in hands of a user for supporting the user exercising on said base; and said front tubes, said rear tubes, said side bars, and said crossbar being circularly shaped when viewed longitudinally.

* * * * *